US006543926B2

(12) United States Patent
Sherez

(10) Patent No.: US 6,543,926 B2
(45) Date of Patent: Apr. 8, 2003

(54) ADAPTER FOR POWER TOOLS

(75) Inventor: Shaul Sherez, Tel Aviv (IL)

(73) Assignee: Bronco Construction Equipment Ltd., Tel Aviv (IL)

( * ) Notice: Subject to any disclaimer, the term of this patent is extended or adjusted under 35 U.S.C. 154(b) by 0 days.

(21) Appl. No.: 09/775,241

(22) Filed: Feb. 1, 2001

(65) Prior Publication Data

US 2002/0024886 A1 Feb. 28, 2002

(30) Foreign Application Priority Data

Aug. 23, 2000 (IL) ..... 138023

(51) Int. Cl.[7] ..... B01F 11/00; B01F 15/00; E04G 21/08

(52) U.S. Cl. ..... 366/108; 366/120; 366/349; 451/461

(58) Field of Search ..... 366/120, 108, 366/118, 121, 122, 123, 129, 600, 349; 451/67, 65, 442, 461, 559

(56) References Cited

U.S. PATENT DOCUMENTS 2,061,943 A * 11/1936 Jorgensen
2,148,765 A * 2/1939 Mall
2,232,842 A * 2/1941 Douglass
2,269,938 A * 1/1942 Jackson
2,276,613 A * 3/1942 Gordon
2,278,839 A * 4/1942 Douglass
2,430,817 A * 11/1947 Jackson
2,492,431 A * 12/1949 Kroeckel
2,598,895 A * 6/1952 Dreyer
2,716,022 A * 8/1955 Wilson
3,042,386 A * 7/1962 Wyzenbeek
3,180,625 A * 4/1965 Wyzenbeek
3,188,054 A * 6/1965 Mason, Jr.
3,402,611 A * 9/1968 Schwenzfeier
3,410,528 A * 11/1968 Clark et al.
3,601,368 A * 8/1971 Uebel
3,782,693 A * 1/1974 Strohbeck
4,057,222 A 11/1977 Lyle (List continued on next page.)

FOREIGN PATENT DOCUMENTS

| | | |
|---|---|---|
| DE | 2117407 | 10/1972 |
| DE | 29515762 | 4/1996 |
| EP | 0321594 | 6/1989 |
| FR | 2749602 | 12/1997 |

OTHER PUBLICATIONS

Oberg, Jones, Horton, and Ryffell, Machinery's Handbook, 26th edition, 2000, Industrial Press Inc. pp1995, 1998–2007, pp. 2047–2057.*

Walsh, McGraw–Hill Machining and Metalworking Handbook, 1994, McGraw–Hill inc., pp 845–849, 864–865, 868–869, 874–879.*

Timings and May, Mechanical Engineer's Pocketbook, 1995, Butterworth–Heinemann Ltd, pp171–179.*

Derwent Information Ltd Abstracts, Derwent Abstract of FR 2749602, Portable vibrating tool for reinforced concree compacting–has vibrating spindle fitted to portable electrically driven drive, Derwent–Acc–No, 1998–042262, 2 pages.*

*Primary Examiner*—Tony G. Soohoo
(74) *Attorney, Agent, or Firm*—Seyfarth Shaw

(57) ABSTRACT

An adapter for coupling to a power tool having a motor with about 2000 W power, the adapter including a transmission for coupling the motor of the power tool to a poker, so as to convert the power tool to the power supply for a concrete vibrator, and a method for making a concrete vibrator, the method including mounting an adapter on a power tool having a motor with about 2000 W power, and coupling the adapter to a poker, thereby converting the power tool to a concrete vibrator.

15 Claims, 8 Drawing Sheets

U.S. PATENT DOCUMENTS 4,135,826 A * 1/1979 Holm
4,823,513 A * 4/1989 Marcus et al.
4,824,258 A * 4/1989 Bodine
5,033,552 A 7/1991 Hu
5,224,803 A 7/1993 Lallier
5,347,765 A * 9/1994 Mixon, Jr. ..... 451/442
5,716,131 A 2/1998 Breeding
5,725,304 A * 3/1998 Inai
5,829,874 A * 11/1998 Breeding
5,993,454 A 11/1999 Longo
6,047,668 A * 4/2000 Yamamoto et al.
6,065,859 A 5/2000 Breeding
6,155,708 A * 12/2000 Lindley

* cited by examiner

ADAPTER FOR POWER TOOLS

FIELD OF THE INVENTION

The present invention relates to concrete vibrators in general and, in particular, to an attachment for converting a conventional power tool to a concrete vibrator.

BACKGROUND OF THE INVENTION

For years, concrete vibrating equipment has been used to create vibration in concrete casting, in order to get homogeneous strength and compaction, as well as to avoid creation of air pockets in the concrete. Until the present day, a dedicated device, which is useful only as a concrete vibrator, has been used. This is due, inter alia, to the fact that a very powerful motor is required.

Conventional vibrators include a vibrating poker connected to a flexible shaft. The vibrating poker is introduced into the concrete and, by the power of the turning motor, it creates vibration throughout the concrete. The poker is usually of the eccenter type or pendulum type. The shaft is generally composed of an outer layer with a flexible cable inside, which transmits power from the motor to the poker. The eccenter type and the pendulum type of vibrator require different motors, as the required rate of rotation differs. Many such vibrators are known in the art.

The connection between the flexible shaft and the motor can be of different types, depending upon the maker of the vibrator and the particular powering unit utilized. The powering units are generally either diesel/gasoline motors, or electric motors.

The electric motors used in concrete vibrators are usually of about 2000 W and either take electricity from the mains line, or from portable generators. They have a suitable connection to the flexible shaft to which the poker is attached.

The fuel engines generally include an adapter mounted on the shaft, the adapter being suitable for connecting the flexible shaft to which the poker is attached.

One example of a pendulum type vibrator is described in U.S. Pat. No. 6,065,859 to Breeding. This vibrator is a portable, hand-held concrete vibrating system employing a pendulous vibrator driven by a high speed, two-cycle motor that operates up to speeds of between 5000 and 6000 rpm. A pivoted weight generally coaxially disposed within the head forcibly causes vibrations in response to internal impacts.

Another example is the portable four cycle backpack pendulous vibrator disclosed in U.S. Pat. No. 5,716,131 to Breeding. The backpack includes a rigid frame mounting a four cycle motor that is connected to the vibrator by a flex-shaft and isolated therefrom by an in-line compensator.

An example of an eccentric vibrator is shown in U.S. Pat. No. 4,057,222. This patent describes an immersion vibrator of the type employed for consolidating poured concrete and employing an unbalanced rotor, characterized by a gerotor type motor, operated by hydraulic pressure, for rotating the rotor.

There are several disadvantages in requiring use of a dedicated concrete vibrator. First, these devices are relatively expensive to manufacture and maintain. Second, if they are not readily available on site when the concrete arrives, work cannot proceed until the vibrator arrives. Third, they add to the quantity of equipment which must be carried from site to site.

Accordingly, there is a long felt need for a device which is convertible to a concrete vibrator or which can be used as a power supply for a concrete vibrator, and it would be very desirable to have such a device which is readily available on building sites.

SUMMARY OF THE INVENTION

According to the present invention, there is provided an adapter for coupling to a power tool having a motor with about 2000 W power, the adapter including a transmission for coupling the motor of the power tool to a poker, so as to convert the power tool to the power supply for a concrete vibrator.

According to one embodiment of the invention, the transmission includes at least two gear wheels coupleable to a chuck or shaft of the motor of the power tool and, via a flexible shaft, to the poker.

There is also provided a method for making a concrete vibrator, the method including mounting an adapter on a power tool having a motor with about 2000 W power, and coupling the adapter to a poker, thereby converting the power tool to a concrete vibrator.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to an adapter for coupling a poker for vibrating concrete and its flexible shaft to the motor of a conventional professional power tool, so as to create a concrete vibrator, at the building site. In this way, no separate, dedicated concrete vibrator is required, but rather the adapter transforms a conventional power tool to a power supply unit for a concrete vibrator. Thus, the concrete vibrator can be formed using any one of a number of readily available single speed power tools, such as electric angle grinders, electric drills, electric circular saws, and other similar tools having the required power, merely by affixing a flexible shaft and poker to the chuck or shaft of the motor of the power tool. In particular, the adapter includes a special gear, which acts as a transmission to provide the appropriate rotation (rpm), and change of axis, if necessary, for the particular poker utilized.

Figure 1:
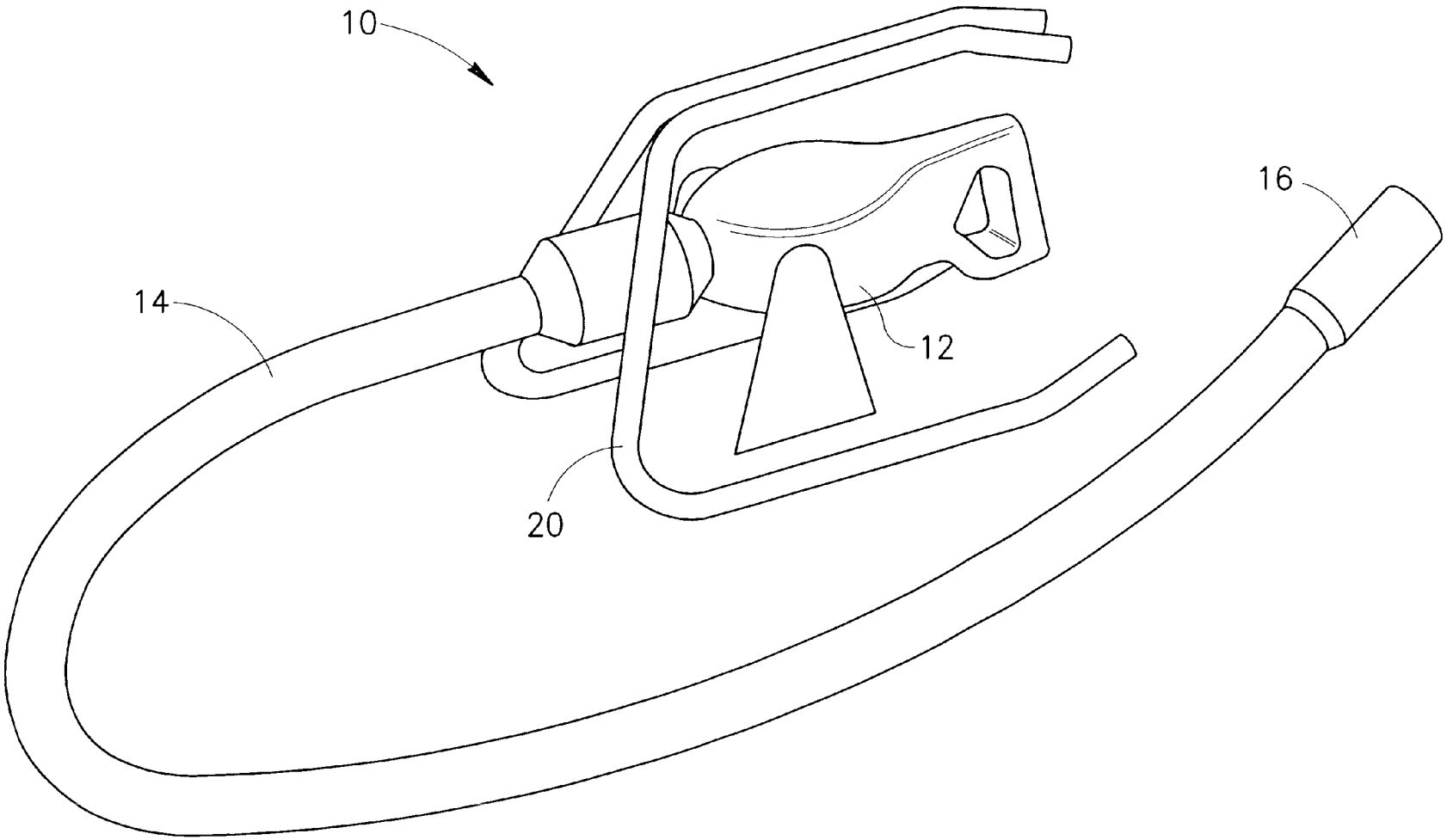
FIG. 1 shows a gear and stand constructed and operative in accordance with one embodiment of the present invention connected to a shaft and poker.

Referring now to FIG. 1, there is shown an adapter 10, constructed and operative in accordance with one embodiment of the present invention, arranged to be coupled to a professional power tool (not shown). Adapter 10 includes a gear 12 arranged to be coupled at one end to the chuck or shaft of the motor of the power tool, and at the other end to a flexible shaft 14 coupled to a poker 16. Poker 16 can be of the eccenter or pendulum type, as desired by the builder.

Preferably, the adapter includes a quick coupling for simple connection to the power tool, without tools. When a quick connector is utilized, the poker can be rapidly and easily removed from the power tool, thereby rendering it available for its conventional usage. Taking advantage of the turning power of the shaft of the electric power tool, the gear 12 develops the rpm and torque necessary to turn the flexible shaft and activate the poker properly. It will be appreciated that the specifications of the particular adapter will change according to the rpm of the particular power tool used and the position of the shaft of the tool.

Due to the power required to actuate the concrete vibrating poker, the power tools which are useful in the present invention are those having a motor having about 2000 W power, plus or minus about 10%.

Figure 2:
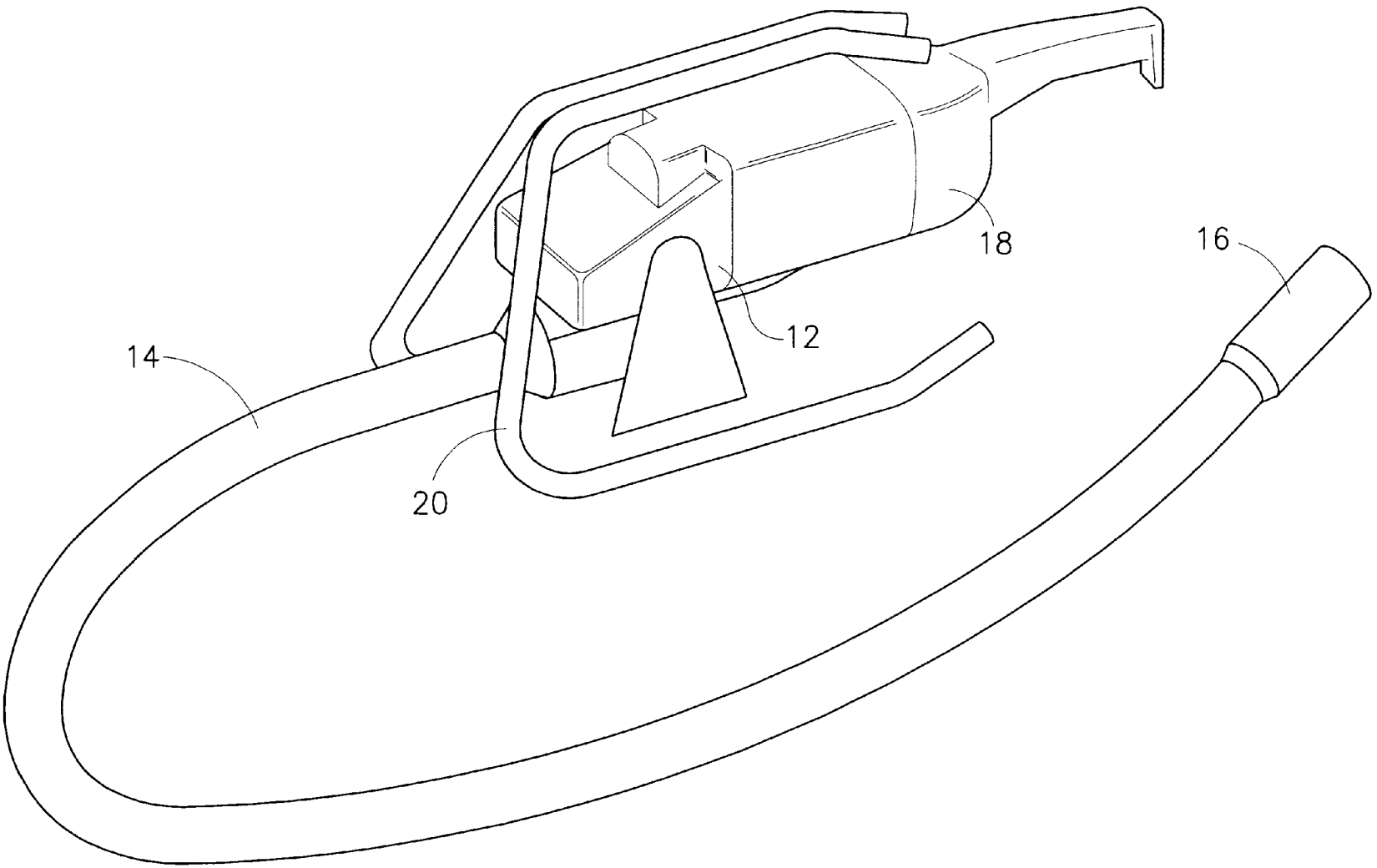
FIG. 2 shows the gear and its stand connected to an electric angle grinder and to the shaft and poker.

Referring now to FIG. 2, there is shown the adapter constructed according to one embodiment of the invention coupled to a professional power tool 18, here shown, by way of example only, as an electric angle grinder. It will be appreciated that, by means of the adapter of the present invention, the motor of the professional power tool is transformed into a power supply unit for the poker of the concrete vibrator.

Figure 3:
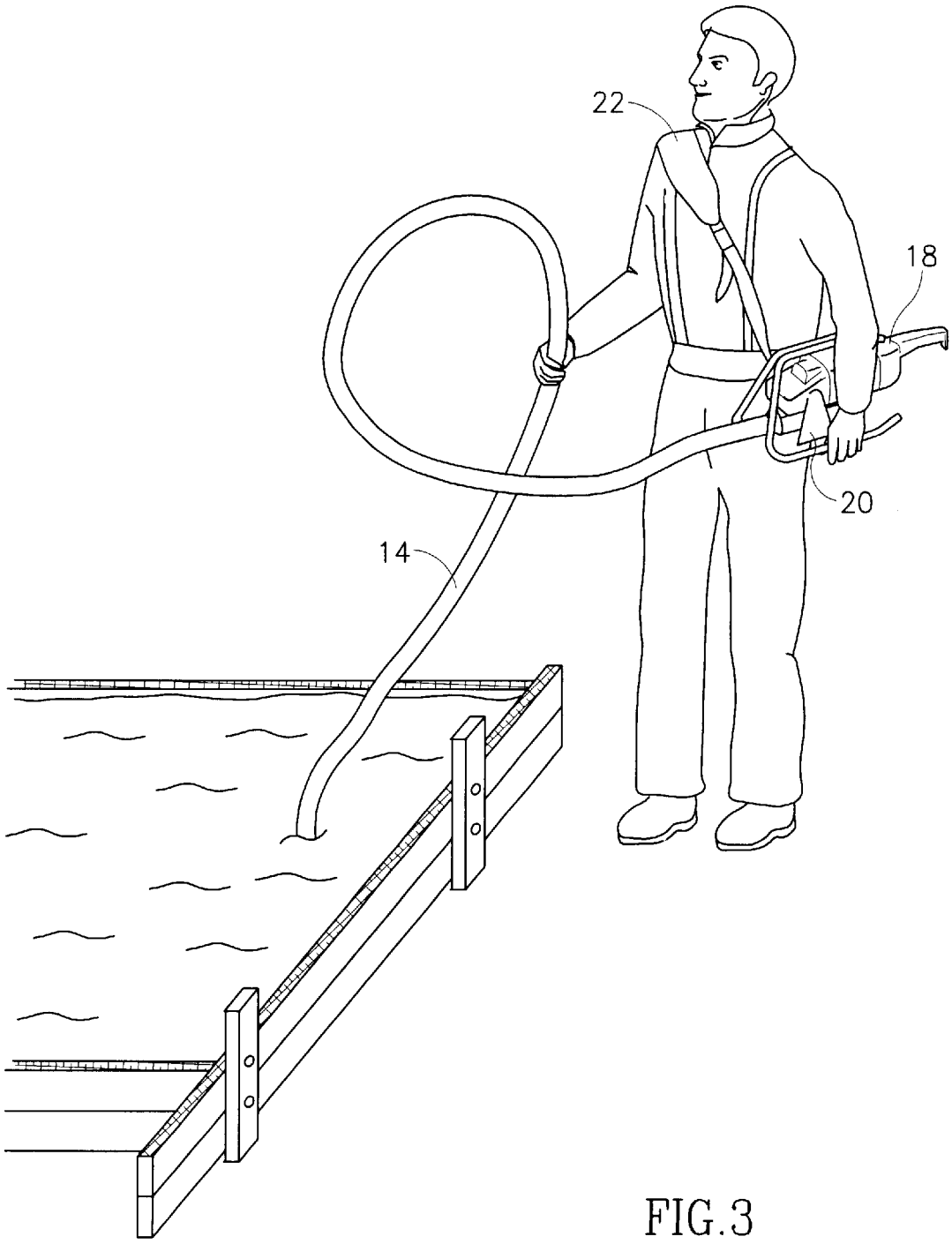
FIG. 3 shows a worker holding the shaft with the poker introduced into the concrete, while a gear according to one embodiment of the invention, attached to an electric angle grinder, is on its stand.
Figure 4:
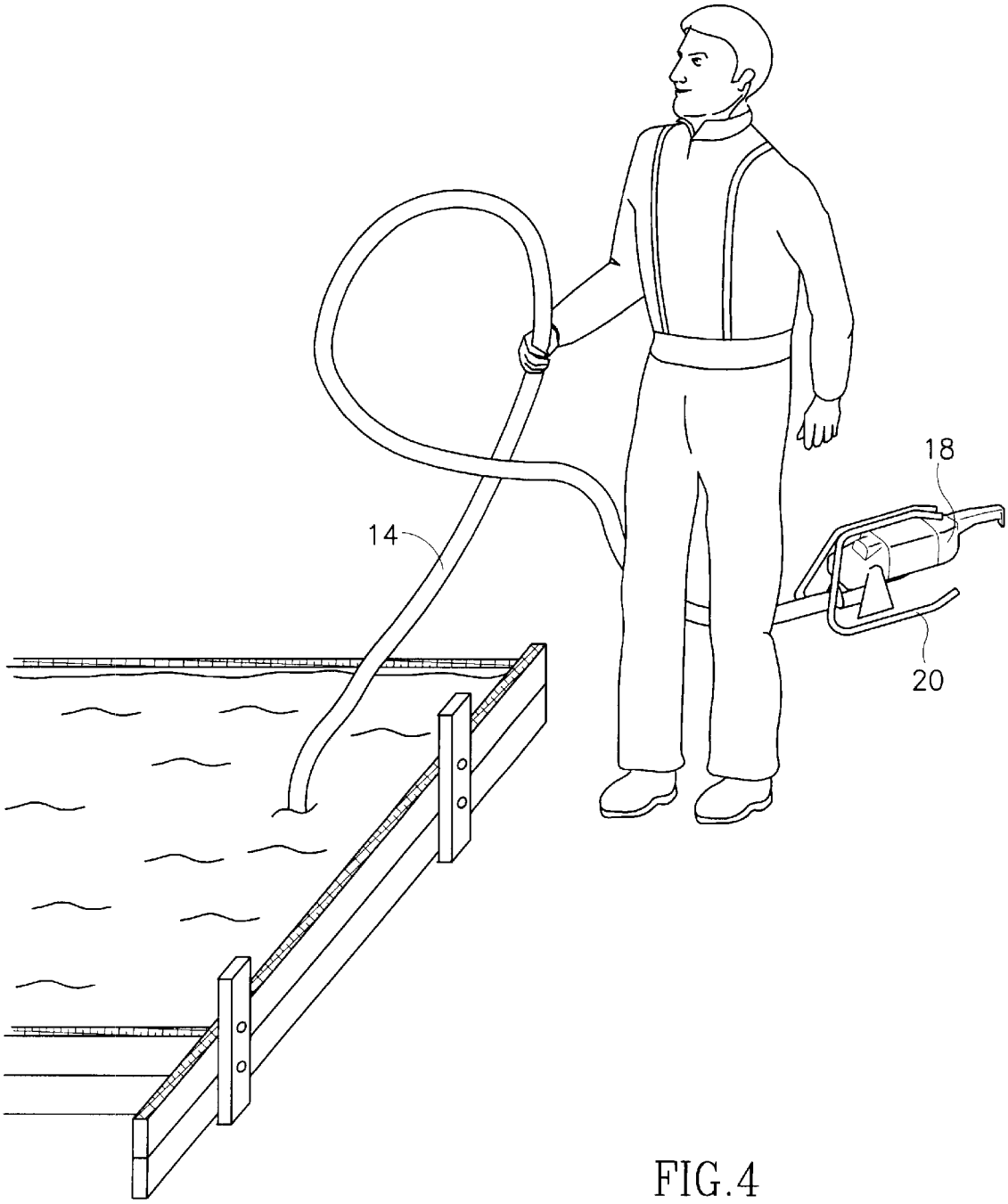
FIG. 4 shows a gear attached to an angle grinder while a worker hangs the unit on his shoulder holding the shaft with the poker introduced inside the concrete.

As seen in FIGS. 1 and 2, the adapter preferably also includes a stand 20, on which the gear 12 is mounted. Stand 20 permits the adapter and power tool to stand on the floor while the vibrator is held in the concrete by a worker, as illustrated in FIG. 3. Alternatively, a shoulder strap 22 can be coupled to stand 20, as shown in FIG. 4, to permit a worker to carry the adapter and power tool on his back, while holding the flexible shaft and poker in his hand.

Figure 5:
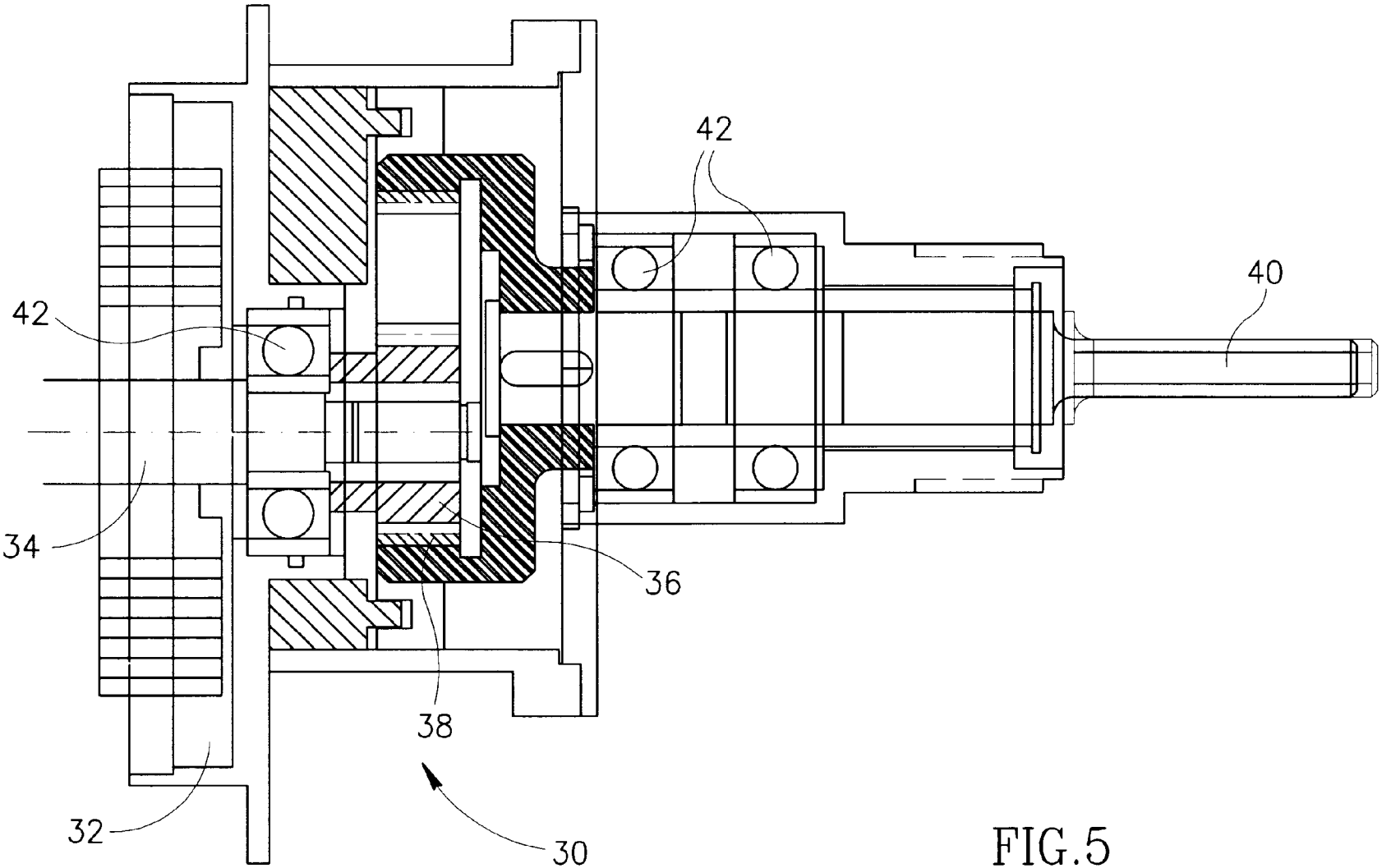
FIG. 5 is a cross section of a gear according to one embodiment of the invention.

With reference to FIG. 5, there is shown an adapter 30 constructed and operative in accordance with one embodiment of the present invention. Adapter 30 includes a quick connector, generally indicated 32 (not illustrated in mechanical detail), for coupling adapter 30 to the shaft 34 of the motor of the power tool. As can be seen, adapter 30 includes a first gear wheel 36 arranged for rotating engagement within a second gear wheel 38 which is, in turn, coupled to a connecting pin 40 onto which the flexible shaft and the poker of the vibrator can be mounted.. Ball bearings 42 are provided, where required.

The gears are preferably of the type Z-45R, M-1.5, and Z=18L, M=1.5, or similar, according to the transmission rate necessary to go from the input rpm to the output rpm with the proper torque. Most preferably, the gears are formed of steel, as it is resistant under the forces generated by the vibrator. The type of ball bearings suitable for use in the present invention are those of the family denominated 6800 DDW and 6000 DDW.

Figure 6:
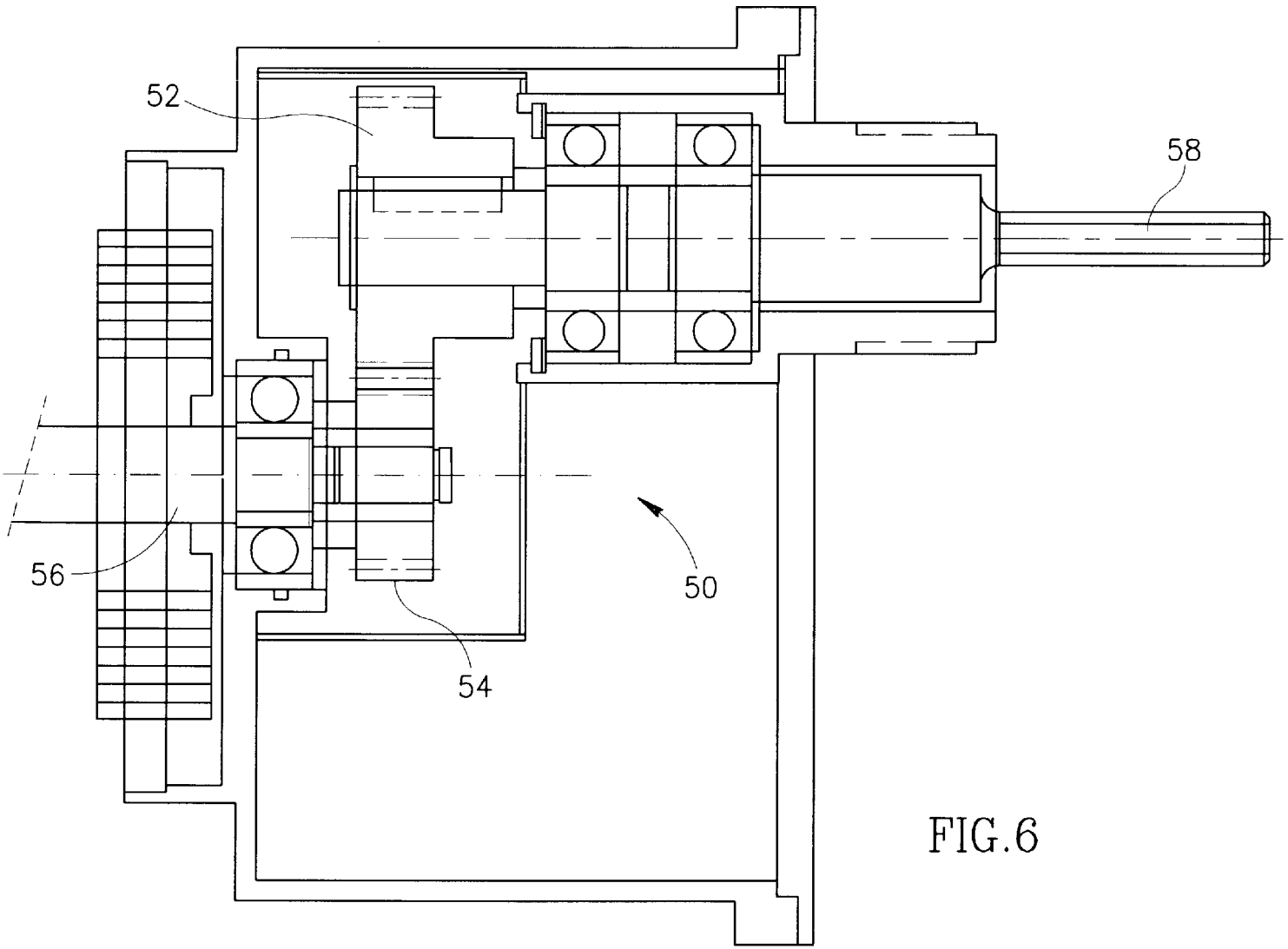
FIG. 6 is a cross section of a gear according to another embodiment of the invention for reducing rpm.

FIG. 6 illustrates an adapter 50 constructed according to an alternative embodiment of the invention, which provides a reduction in the rpm of the flexible shaft relative to the rpm of the motor of the power tool. This is accomplished by providing a gear wheel 52 adjacent the gear wheel 54 coupled to the motor shaft 56. Gear wheel 52 is coupled to a connecting pin 58 which will be connected to the flexible shaft of the vibrator, and thus to the poker. In the illustrated embodiment, the connecting pin is male. Alternatively, a female connector can be provided on the adapter for fitting to a male connector on the flexible shaft.

Figure 7:
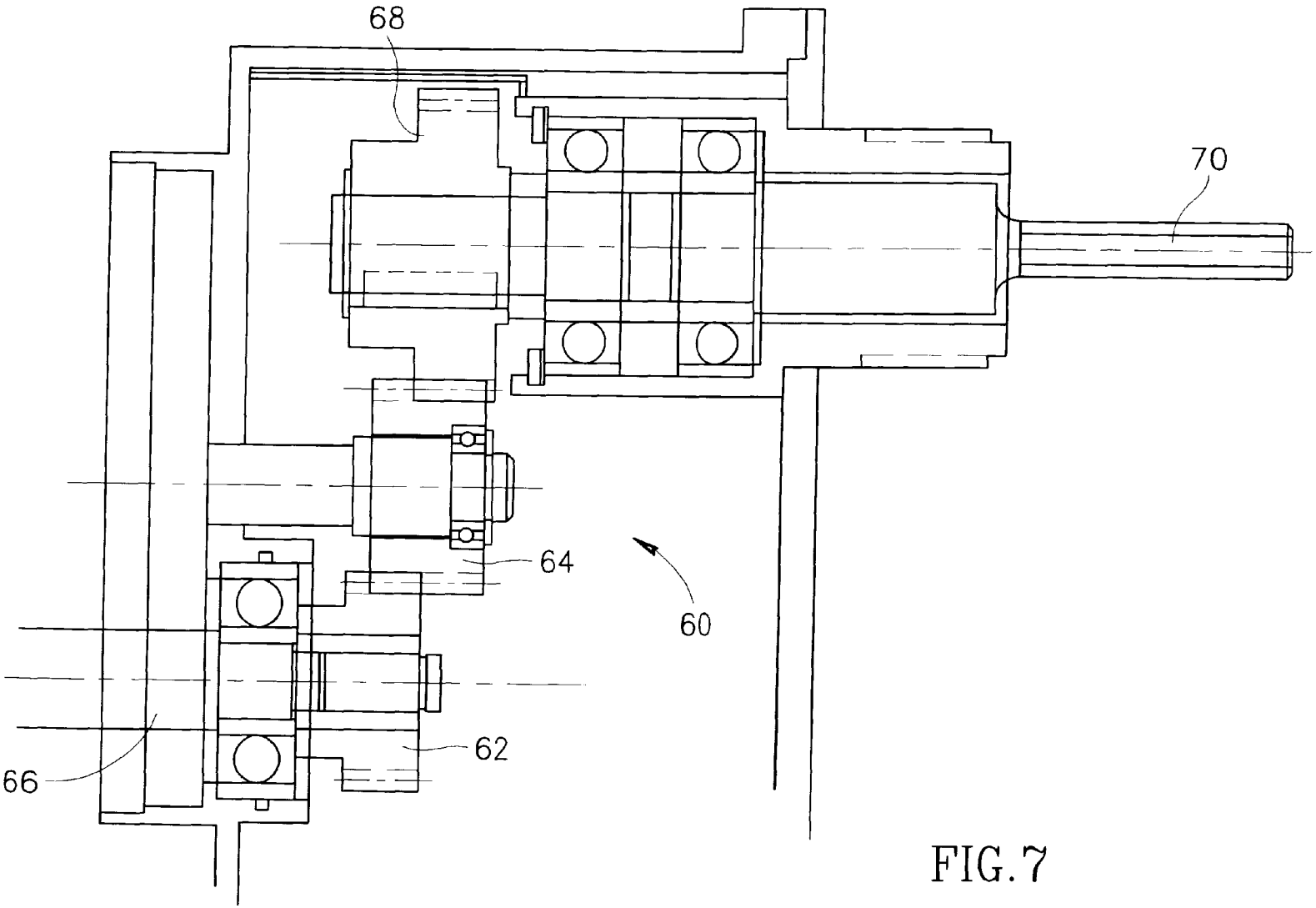
FIG. 7 is a cross section of a gear according to yet another embodiment of the invention.

FIG. 7 illustrates an adapter 60 constructed according to an alternative embodiment of the invention, which provides a further reduction in the rpm of the flexible shaft relative to the rpm of the motor of the power tool. This is accomplished by providing an additional gear wheel 64 between the gear wheel 62 coupled to the motor shaft 66, and the gear wheel 68 coupled to the connecting pin 70 for connection to the flexible shaft and the poker of the vibrator.

It is a particular feature of the present invention that virtually any desired rpm of the vibrator shaft can be achieved, by changing the combination of gear wheels in the adapter. Alternatively, a differential gear, or any other transmission system which can be adapted to convert the motor of a professional power tool to a power supply for driving a concrete vibrator, can be utilized.

Figure 8:
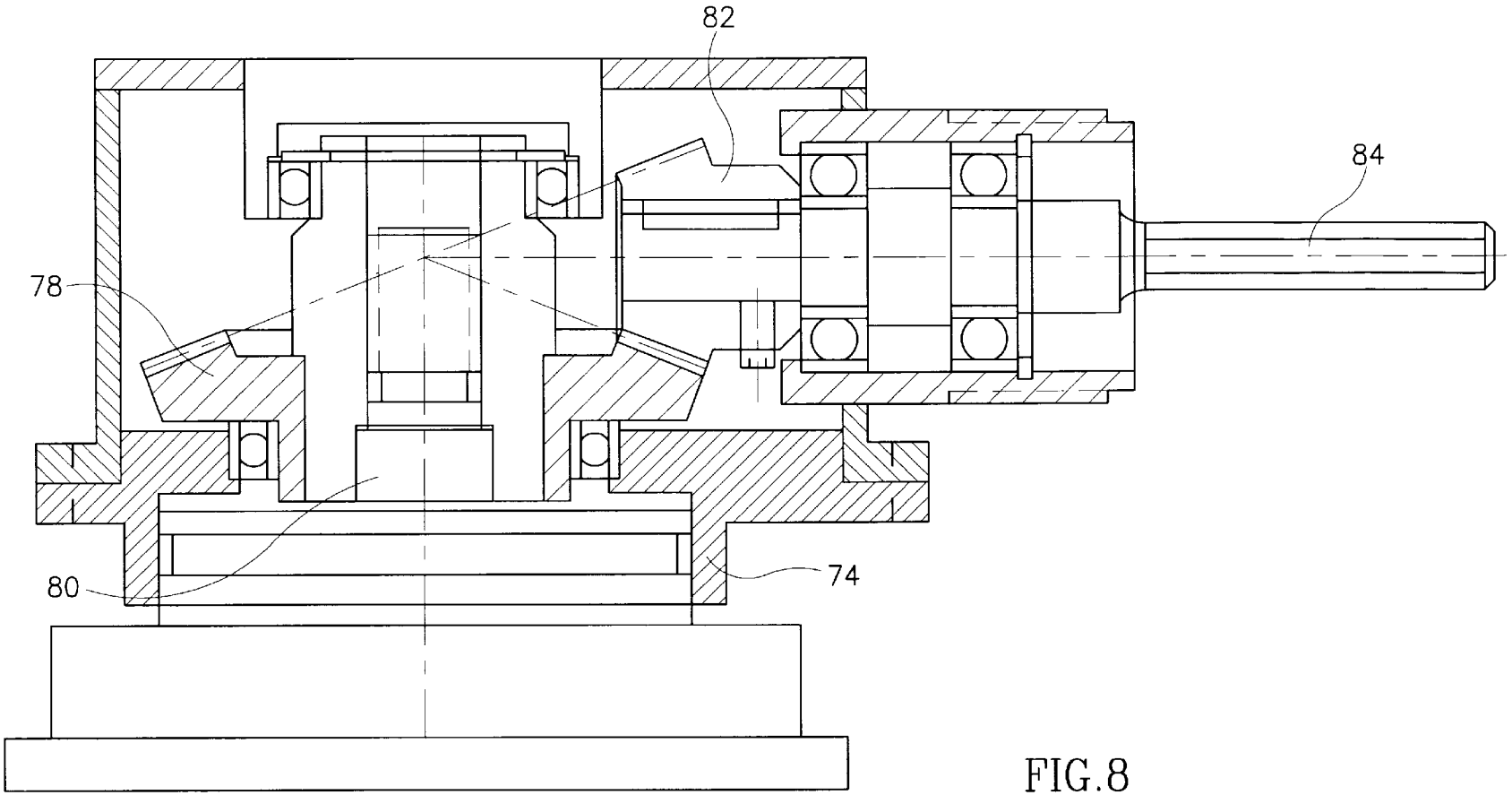
FIG. 8 shows corona and pinion type transmission gears transforming the turning power on the Y axis into turning power on the X axis at the required rpm, according to a further embodiment of the invention.

Yet another embodiment of the invention is illustrated in FIG. 8. FIG. 8 shows an adapter 72, which transforms the turning power on the Y axis from the power tool into turning power on the X axis, at the required rpm for the vibrator. Adapter 72 includes a quick connector 74 for coupling adapter 72 to the shaft 76 of the motor of the power tool. Adapter 72 also includes a corona gear 78 coupled to the shaft 80 of the power tool, and a pinion gear 82 coupled to the connecting pin 84 for the flexible shaft and poker of the vibrator.

It will be appreciated that the invention is not limited to what has been described hereinabove merely by way of example. Rather, the invention is limited solely by the claims which follow.

What is claimed is:

1. An adapter for coupling to an angle grinder having a motor capable of producing about 2000 W power and an output number rotatable about a first axis to convert the angle grinder to a power source for vibrating concrete, the adapter comprising:

connectors for coupling to the output member of the angle grinder and to a flexible shaft of a vibrating poker, and a transmission for converting the direction of the rotational motion of the output member of the angle grinder to a rotational motion about a second axis different from the first axis for connection to the flexible shaft, thereby converting the angle grinder to a power source for powering the poker for vibrating concrete.

2. The adapter according to claim 1, further comprising a quick coupling for connecting the adapter to the angle grinder.

3. The adapter according to claim 2, wherein said transmission includes at least two gear wheels for transferring rotation of the motor of the angle grinder at a selected rpm to the poker.

4. The adapter according to claim 2, wherein said transmission includes two gear wheels arranged one adjacent the other in rotating engagement.

5. The adapter according to claim 2, wherein said transmission includes a corona gear coupleable to a shaft of the motor of the angle grinder, and a pinion gear coupleable to a shaft of the poker, for creating rotation in a direction perpendicular to the motor of the angle grinder at a selected rpm.

6. The adapter according to claim 1, wherein said transmission includes at least two gear wheels for transferring rotation of the output member of the angle grinder at a selected rpm to the poker.

7. The adapter according to claim 1, wherein said transmission includes two gear wheels arranged one adjacent the other in rotating engagement.

8. The adapter according to claim 1, wherein said transmission includes a corona gear coupleable to a shaft of the motor of the angle grinder, and a pinion gear coupleable to a shaft of the poker, for creating rotation in a direction perpendicular to the motor of the angle grinder at a selected rpm.

9. The adapter according to claim 1, wherein one of the connectors is adapted for effecting a quick coupling to the rotatable output member.

10. The adapter according to claim 1, wherein the first and second axes are substantially perpendicular to each other.

11. A method for making a concrete vibrator comprising:

providing an angle grinder having a motor capable of producing about 2000 W power and an output member rotatable about a first axis, providing a vibrating poker with a flexible shaft, providing an adapter including a transmission and connectors for coupling the adapter to the output member of the angle grinder and to the flexible shaft of the vibrating poker, the transmission converting rotational motion about the first axis to rotational motion about a second axis substantially perpendicular to the first axis, and removably coupling the adapter to the output member of the angle grinder and to the flexible shaft of the vibrating poker, whereby the rotational motion of the angle grinder output member about the first axis is converted to a rotational motion about the second axis for vibrating the poker.

12. The method of claim 11, therein the removable mounting includes quick coupling the transmission to the rotatable output member.

13. A method for converting an angle grinder into a vibrating generator for vibrating concrete comprising:

providing an angle grinder having a motor capable of producing about 2000 W power and an output member rotatable about a first axis, providing an adapter including connectors for coupling to the output member of the angle grinder and to a flexible shaft of a vibrating poker, the adapter including a transmission for converting the rotational motion of the angle grinder output member about the first axis to a rotational motion about a second axis substantially perpendicular to the first axis for connection to the flexible shaft, and coupling the adapter to the output member of the angle grinder to form a power supplier for coupling to a flexible vibrating poker for vibrating concrete.

14. The method of claim 13, wherein the coupling includes quick coupling of the transmission to the rotatable output member.

15. In combination:

an angle grinder having a motor capable of producing about 2000 W power and an output member rotatable about a first axis; and an adapter mounted on the angle grinder and adapted for use with a flexible shaft of an associated concrete vibrator, the adapter including connectors for coupling to the output member of the angle grinder and to the flexible shaft of the vibrator, and a transmission for converting the direction of the rotational motion of the output member of the angle grinder to a rotational motion about a second axis different from the first axis for connection to the flexible shaft, thereby converting the angle grinder to a power source for powering the vibrator.

* * * * *

UNITED STATES PATENT AND TRADEMARK OFFICE

CERTIFICATE OF CORRECTION

PATENT NO. : 6,543,926 B2
DATED : April 8, 2003
INVENTOR(S) : Shaul Sherez

It is certified that error appears in the above-identified patent and that said Letters Patent is hereby corrected as shown below:

Column 4,
Line 40, change “number” to -- member --.

Signed and Sealed this

Twenty-second Day of July, 2003

JAMES E. ROGAN
*Director of the United States Patent and Trademark Office*